US006372296B2

(12) United States Patent
van Ooij et al.

(10) Patent No.: US 6,372,296 B2
(45) **Date of Patent: *Apr. 16, 2002**

(54) HIGH ALUMINUM GALVANIZED STEEL

(75) Inventors: Wim J. van Ooij, Fairfield; Prasanna Vijayan, Cincinnati, both of OH (US)

(73) Assignee: University of Cincinnati, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/316,612

(22) Filed: May 21, 1999

(51) Int. Cl.[7] ..... B05D 1/18; B05D 1/36

(52) U.S. Cl. ..... 427/433; 427/405; 427/406; 427/437; 427/438; 427/443.1; 427/320; 427/321; 427/329

(58) Field of Search ..... 427/433, 329, 427/405, 406, 437, 438, 443.1, 320, 321

(56) References Cited

U.S. PATENT DOCUMENTS 3,952,120 A * 4/1976 Horton et al. ..... 427/433
3,962,501 A * 6/1976 Ohbu et al. ..... 427/433
4,093,466 A * 6/1978 Davis ..... 106/1.22
4,128,676 A * 12/1978 Lee ..... 427/433
4,285,995 A * 8/1981 Gomersall ..... 427/383.9
4,505,958 A * 3/1985 Lieber et al. ..... 427/433
4,618,513 A * 10/1986 Kinkelaar et al. ..... 427/443.1
6,284,122 B1 * 9/2001 Memmi et al. ..... 205/220

FOREIGN PATENT DOCUMENTS

JP 9-25550 * 1/1997

* cited by examiner

*Primary Examiner*—Michael Barr
(74) *Attorney, Agent, or Firm*—Frost Brown Todd LLC

(57) ABSTRACT

The present invention relates to galvanized steel having a high aluminum content in the coating, as well as a batch hot-dip galvanization process for making such steel. The galvanized steel herein has a coating comprising an inner layer of intermetallic iron aluminum compounds, such as $Fe_2Al_5$ (which may have some zinc present), and an outer layer of intermetallic zinc aluminum compounds containing from about 17% to about 40% (preferably about 22%, the Zn—Al eutectoid) aluminum (which may have some iron present). The batch hot-dip galvanization process for making such steel comprises: (a) fluxing the steel by electroless plating on the surface of the steel of a metal such as tin, copper or nickel; and (b) dipping the fluxed steel into a molten galvanization bath comprising zinc and from about 17% to about 40% aluminum.

11 Claims, No Drawings

HIGH ALUMINUM GALVANIZED STEEL

TECHNICAL FIELD

The present invention relates to galvanized steel having a high aluminum content in the coating, as well as a batch hot-dip galvanization process for making such steel.

BACKGROUND OF THE INVENTION

The importance of providing protection against corrosion for steel articles used outdoors (such as fences, garbage cans, and automobile parts) is obvious, and coating the steel with zinc is a very effective and economical means for accomplishing this end. Zinc coatings are commonly applied by dipping or passing the article to be coated through a molten bath of the metal. This operation is termed "galvanizing," "hot galvanizing" or "hot-dip galvanizing" to distinguish it from zinc electroplating processes. The steel galvanizing process is very well-known in the art and, for example, is discussed in detail in *The Making, Shaping, and Treating of Steel*, United States Steel Corporation, $7^{th}$ Edition, Pittsburgh, 1957, pages 660–673, and the $10^{th}$ edition, Lankford et al. (eds.), Association of Iron and Steel Engineers, Pittsburgh, 1985, pages 1173–1189, incorporated herein by reference. Galvanization processes generally fall into one of two types: (1) batch hot-dip galvanizing, which is the hot-dip galvanizing of pre-formed articles by passing them one by one and in close succession through the molten zinc, and (2) continuous (strip) hot-dip galvanizing, in which steel in coiled form from the rolling mills is uncoiled and passed continuously through the galvanizing equipment, continuity of operation being achieved by joining the trailing end of one coil to the leading end of the next.

Batch galvanizing is an old and well-known process, having been practiced for over 200 years. The basic steps in the batch galvanizing process include: alkaline degreasing followed by pickling (usually in hydrochloric acid or sulfuric acid) to remove rust and clean the surface of the steel; fluxing to protect the active surface of the steel from oxidation and to improve the wetting of the steel surface by molten zinc in the galvanization step; and dipping the steel in a bath of molten zinc. Continuous galvanization is similar, except that fluxing is typically not included since there is generally no significant delay before the prepared steel is dipped in the molten zinc. Batch galvanization and continuous galvanization have some other very significant differences:

(1) The steel article or sheet is dipped in the molten zinc for a much longer time in batch galvanization (three minutes, as compared with about ten seconds in a continuous process);

(2) The batch process forms zinc iron alloys at the steel surface, while the continuous process generally does not;

(3) Galvanized steel from a batch process generally cannot be deformed significantly, while the product from a continuous galvanization process generally can (requiring that batch galvanized items generally be formed prior to galvanization); and (4) The thickness of the film formed in batch galvanization is about 75 $\mu$m, while the film formed in the continuous galvanization process is only about 20 $\mu$m.

Flux protects the steel surface from oxidation during any delay prior to the time the steel object is dipped in the molten zinc-galvanizing tank. Flux is typically used in a batch galvanization process but not in a continuous process, since there generally would be little or no delay prior to the galvanization step in a continuous process. Essentially one type of flux is currently used in industrial galvanization. In this conventional flux process, the steel sheet or object is dipped in an aqueous solution containing ammonium chloride and zinc chloride. This forms a zinc ammonium chloride film on the surface of the object or sheet. Even if the specific compounds used in the flux process are varied, they generally contain chloride salts. In a variation of this procedure, called "top" or "wet kettle" fluxing, the flux is present in a layer which sits on top of the galvanizing bath. As the steel article passes through this top layer, it is fluxed on its way into the galvanizing bath. While zinc ammonium chloride fluxing does prevent oxidation of the steel surface, it also presents some significant problems:

(1) While the operable time window between surface cleaning and the galvanization step is extended using the flux, that interval before oxidation begins is still relatively short (about two hours);

(2) Dipping the fluxed article in the molten zinc bath produces hydrogen chloride and other toxic fumes; and (3) While it is desirable to include aluminum in the zinc bath in order to provide an anti-corrosion benefit to the galvanized coating, the chloride in conventional flux reacts with aluminum in the zinc bath, rendering the galvanization process ineffective.

The basic galvanization process, as well as a variety of attempts to address the problems associated with conventional fluxes, discussed above, are well known in the art and are exemplified by the following references.

*The Making, Shaping and Treating of Steel*, United States Steel Corporation, $7^{th}$ Edition, 1957, Pittsburgh, Chapter 39, pages 660–673, and the $10^{th}$ edition, Lankford et al. (eds.), Association of Iron and Steel Engineers, Pittsburgh, 1985, pages 1173–1189, contains a description of galvanization and the conventional processes used to galvanize steel.

Japanese Published Patent Application 07/233,459 (Toho AEN KK), published Sep. 5, 1995, describes a flux which comprises an aqueous solution of tin chloride and ammonium acetate. The flux is taught to be used prior to the galvanization of wires in a zinc-aluminum bath.

Japanese Published Patent Application 05/195,179 (Fuji Kogyo KK), published Aug. 3, 1993, describes a flux solution used for hot-dip zinc-aluminum galvanization, comprising an aqueous solution of $MnCl_2.4H_2O$, zinc chloride, tin chloride and potassium formate.

Japanese Published Patent Application 05/148,602 (Fuji Kogyo KK), published Jun. 15, 1993, describes a flux solution used in a zinc-aluminum galvanizing process, comprising zinc chloride, tin chloride, potassium formate and hydrochloric acid in an aqueous solution.

Japanese Published Patent Application 05/117,835 (Sumitomo Metal Mining Co./Tanaka AEN Metsuki KK), published May 14, 1993, describes a flux, used in a hot-dip galvanizing process, comprising an aqueous solution of ammonium chloride, zinc chloride, bismuth chloride or stannous chloride, together with an alcohol.

Japanese Published Patent Application 04/157,146 (Sumitomo Metal Mining Co.), published May 29, 1992, describes a flux used for hot-dip zinc-aluminum galvanization, comprising zinc chloride, tin chloride, and the chloride of at least one alkaline metal element.

Although the two processes are completely different, it should be noted for the sake of completeness that tin is known for use as a component of soldering flux. See, for example, U.S. Pat. No. 4,954,184 (Day Manufacturing Company, Inc.), issued Sep. 4, 1990.

British Patent 1,502,673 (BASF), issued Mar. 1, 1998, describes an aqueous flux, which is said to give off only low levels of fumes and smoke when used prior to hot-dip zinc galvanization, comprising zinc chloride, potassium chloride, and optionally components selected from sodium chloride, ammonium chloride and aluminum chloride.

As noted above, a problem with conventional batch galvanization processes is that they do not permit the inclusion of aluminum in the molten zinc galvanizing bath. Specifically, the chloride contained in standard fluxes reacts with any aluminum present forming volatile $AlCl_3$. This decreases the bath efficiency since it alters the bath composition; also, the coating quality is adversely affected. It is useful and desirable to include higher levels of aluminum in such coatings because that tends to increase the durability and corrosion resistance of the galvanized steel.

U.S. Pat. No. 5,292,377, Izeki, et al. (Tanaka Galvanizing Co./Sumitomo Metal Mining Co.), issued Mar. 8, 1994, describes a process for galvanizing steel with a zinc/aluminum coating to enhance the corrosion resistance of the finished product. This process is an adaptation of the conventional fluxing process to try to make it compatible with the inclusion of aluminum in the zinc bath. Specifically, the flux comprises zinc chloride or stannous chloride, together with an alkali metal or alkaline earth metal chloride and an alkyl quaternary ammonium salt or alkyl amine.

U.S. Pat. No. 4,448,748, Radtke et al., issued May 15, 1984, describes the Galfan aluminum-zinc product which can contain up to 15% aluminum, as well as a rare earth-containing metal such as mischmetal. The examples included in the patent are of continuous galvanization, which is not surprising since standard batch galvanization fluxes are not compatible with the inclusion of aluminum in the galvanizing bath.

U.S. Pat. No. 4,056,366, Lee et al., issued Nov. 1, 1977, describes a continuous galvanization process which is said to be able to provide coatings containing up to about 17% aluminum.

U.S. Pat. No. 4,292,377, Izeki, et al., issued Mar. 8, 1984, describes a flux containing certain specific metal chlorides in combination with aliphatic nitrogen derivatives which is said to allow the use of aluminum in a batch galvanization process. The examples show galvanization batches containing up to 10% by weight aluminum.

Townsend and Borzillo, Conference Proceedings, presented at European Galvanizing Conference, Birmingham, England (1997), describes Bethlehem Steel's Galvalume galvanized sheet product which contains about 55% by weight aluminum in the coating. This material is made by a continuous process and is said to provide long-term corrosion resistance. See also U.S. Pat. No. 4,350,540, Townsend and Borzillo, Materials Performance, pp. 31–36 (H. E. Townsend and A. R. Brozillo, Materials Performance, 35[4] (April, 1996).

It has now surprisingly been found that if the batch galvanization process described in the present application is used, galvanized steel articles containing high levels of aluminum (from about 17% to about 40%) can be formulated. Because these articles are galvanized in a batch process, the processing times are longer and the processing temperatures somewhat lower than they would be for a continuous process, providing the finished product with an unique metallurgical structure.

The present invention, its variations and its many benefits are described in greater detail below.

SUMMARY OF THE INVENTION

The present invention relates to a high aluminum-content galvanized steel, articles made from that steel, and the process for making that steel. This galvanized coating provides outstanding corrosion resistance and excellent mechanical properties. The steel has a coating which comprises an inner layer of intermetallic iron-aluminum compounds (which may have some zinc present) and an outer layer of a zinc aluminum alloy (which may have some iron present) containing from about 17% to about 40%, preferably about 22% (corresponding to the Zn—Al eutectoid composition) aluminum.

This galvanized steel is made using a hot-dip batch galvanized process comprising the steps of:

(a) fluxing said steel article by electroless plating on the surface of said steel article a layer of a metal (for example, tin, copper, nickel, cobalt, manganese, zirconium, chromium, lead, mercury, silver, gold, platinum, palladium and molybdenum (preferably tin, copper or nickel, most preferably tin)); and (b) galvanizing said steel article by dipping it in a bath comprising molten zinc and from about 17% to about 40% (preferably about 22%) aluminum.

All ratios and percentages given herein are "by weight", unless otherwise specified.

As used herein, the phrase "steel article" or "steel object" is intended to include, in addition to individual pre-formed steel articles, steel sheets, which are to be galvanized. It is not intended to include steel strip.

DETAILED DESCRIPTION OF THE INVENTION

The present invention relates to an improvement in the fluxing step used in the galvanizing process for steel, and high aluminum-content steel made using that improved process. Such galvanizing processes, in general, are well-known and fully described in the art; they consist generally of two types: continuous galvanization and batch galvanization. See, for example, *The Making, Shaping and Treating of Steel*, United States Steel Corporation, $7^{th}$ Edition, 1957, Pittsburgh, Chapter 39, pages 660–673, 1957, and the $10^{th}$ edition, Lankford et al. (eds.), Association of Iron and Steel Engineers, Pittsburgh, 1985, pages 1173–1189, incorporated herein by reference. The improvement of the present invention is useful in any galvanizing process, but is especially useful in batch galvanization processes for steel where there is frequently a significant time delay between the fluxing of an article and the actual galvanization of that article.

In a typical batch galvanization process, the surface of the article to be galvanized is treated to remove rust and other foreign materials, the article is then fluxed and, finally, it is dipped in molten zinc to provide the galvanization. The surface preparation steps (i.e., degreasing and pickling) utilized in the process of the present invention are conventional and are known in the art. The purpose of these steps is to remove rust and other foreign materials from the surface of the steel article. This is generally accomplished by a degreasing step (to remove organic contaminants from the steel surface) in which the article is dipped in a heated alkaline solution. In a typical degreasing step, the steel article is dipped for about 5 to about 60 minutes in an alkaline solution containing sodium hydroxide and sodium orthosilicate in a weight ratio of about 1:1, and a concentration of 10 to 15%, at a temperature of about 60° C. to about 80° C. Other alkaline materials, such as potassium hydroxide, can be used. After this degreasing step is completed, the steel article is generally rinsed with water to remove the alkaline solution and any foreign substances (e.g., dirt and other organic particles) sticking to its surface.

This is typically followed by a pickling step (to remove mill scale and rust from the steel surface) wherein the steel article is dipped in an acid solution, preferably one containing hydrochloric acid or sulfuric acid. Pickling for sheet galvanizing is usually conducted as a batch operation in stationary tubs provided with an agitating means. This operation may sometimes be conducted as a continuous process in equipment provided with a sheet conveyor and means for electrolytic acceleration. Very light pickling, requiring only a short time exposure to the pickling solution, has been found suitable for products, such as roofing and siding, that require little mechanical deformation. Deep etching (i.e., heavy pickling) of the base metal has generally been found to be necessary when forming requirements are severe. The pickling is generally accomplished by dipping the article for as long as 5 to 30 minutes in a 10 to 15% aqueous solution of sulfuric acid (or hydrochloric acid), containing about 0.5% to about 0.7% of a pickling inhibitor, at room temperature or a temperature of about 50° C. to about 70° C. Higher bath temperatures require shorter immersion times. Typically, after the pickling step is concluded, the article is rinsed with water to remove excess pickling solution and iron salts sticking to the steel surface. The result of these processes is an object having a very active surface, since all the rust and other foreign materials have been removed, making it highly susceptible to oxidation.

The fluxing step protects the surface of the steel article from oxidation until it is galvanized. The improved fluxing step described herein enables the formation of the high aluminum steel of the present invention and is described in U.S. patent application Ser. No. 09/136,753, Van Ooij and Vijayan, filed Aug. 19, 1998, now abandoned. Thus, rather than depositing a chloride salt on the surface of the article, as would be done using the conventional fluxing process, the present invention deposits a layer of a metallic element on the steel surface. The thickness range of this metal layer is from about 1 nm to about 10 $\mu$m, preferably from about 1 nm to about 0.1 $\mu$m, and most preferably from about 5 to about 50 nm.

Any method of depositing the metal on the steel surface may be used in the process of the present invention. However, electroless plating is the preferred deposition method. Electroless plating is a process well-known in the art and is described, for example, in Lowenheim (ed), *Modem Electroplating,* 3$^{rd}$ edition, 1974, John Wiley & Sons, New York, incorporated herein by reference. In it, the metal is plated out onto the steel surface from a solution containing a reducing agent. When electroless plating is used as the deposition method on steel, any metal which is galvanically more noble than iron may be used in the fluxing process of the present invention, i.e., any metal that can be deposited on the steel surface by electroless plating can be used. Examples of such metals include tin, copper, nickel, cobalt, manganese, zirconium, chromium, lead, mercury, gold, silver, platinum, palladium, molybdenum and mixtures thereof. Aluminum and zinc, for example, cannot be electrolessly plated onto steel and, therefore, cannot be used as fluxes in the present invention. Preferred metals from this group are those which are relatively inexpensive, non-toxic and commercially available. These include tin, copper and nickel. Tin is particularly preferred since it meets all of the above criteria and does not negatively interact with the steel when it is applied.

In the electroless plating process, tin or another appropriate metal is deposited from an appropriate salt out of an aqueous solution having an acid pH. This process is well-known in the art and is described, for example, in Lowenheim (ed), *Modern Electroplating*, cited above, see especially pages 412–415, incorporated herein by reference. In this process, the metal is deposited from its salt on the steel surface without the aid of an outside source of electric current or a chemical reducing agent in solution. The process is simple, requires only a small investment in equipment and permits the deposit of the metal in recesses on the article. The electroless plating is generally carried out over a time period of from about 1 to about 10 minutes, preferably from about 1 to about 5 minutes, most preferably from about 1 to about 2 minutes; at a temperature of from about 50 to about 100° C., preferably from about 70 to about 80° C.; from an aqueous solution having pH of from about 1 to about 7, preferably from about 1 to about 4. Examples of salts which can be used to provide the metal in the electroless plating process include metal chlorides, acetates, sulfates and cyanates, with chlorides being preferred. It is preferred that the acidic pH of the fluxing solution be provided by hydrochloric acid and that the tin metal be provided by stannous chloride ($SnCl_2$), although any tin salt from which the tin will plate out on steel may be used. A particularly preferred aqueous solution for carrying out the fluxing process of the present invention includes from about 1% to about 15%, preferably about 5%, hydrochloric acid and from about 1% to about 25%, preferably about 10%, $SnCl_2.2H_2O$.

The fluxing process of the present invention remains effective even as iron and zinc build up in the flux bath, as frequently happens as a bath is being used. Thus, the flux baths used in practicing the present invention may contain up to about 10% iron ($Fe^{3+}$) and up to about 3% zinc ($Zn^{2+}$).

The mechanics of the galvanizing step are well-known in the art. In this step, for example, the fluxed article is dipped into a molten zinc bath for about three minutes at a temperature of about 510–530° C. Typically, the residence time in the bath is from about 1 to about 5 minutes, preferably from about 2 to about 3 minutes, most preferably about 3 minutes, and the bath temperature is from about 500° C. to about 600° C., preferably from about 510° C. to about 530° C. The precise residence time and temperature can be adjusted based on the content of the galvanization bath, the steel to be coated, and the characteristics desired, to optimize the process. The equipment typically used for sheet galvanizing consists of mechanical facilities for transporting cut length sheets or other articles successively through acid washing, fluxing, hot-dipping, and cooling operations. The coating bath, itself, is contained in a heated low carbon steel vessel or pot. A framework or rigging, typically including suitable entry feed rolls, sheet guides, driven bottom pinch rolls, and driven exit rolls, is suspended in the bath in such a manner as to completely submerge all but the entry rolls, part of the exit rolls, and part of the supporting framework.

Small quantities of other metals may be added to the zinc-aluminum bath to control the appearance and properties of the coatings formed. For example, lead, antimony, nickel, magnesium, manganese, tin, bismuth, cobalt, or mixtures of these metals may be added at low concentrations to control viscosity of the bath (which, in turn, controls thickness of the coating), dross formation and reactivity of the bath, as well as other coating properties.

The key aspect of the present invention is the inclusion of aluminum in the zinc-galvanizing bath. Conventional fluxing processes are incompatible with the use of aluminum in the galvanizing step, since those fluxing processes result in a zinc ammonium chloride layer being formed on the fluxed steel, the chloride layer reacting negatively with aluminum in the galvanizing bath. The flux described herein, however permits the inclusion of relatively high levels of aluminum in the zinc galvanization bath. In fact, the galvanization bath herein comprises from about 17% to about 40%, preferably from about 20% to about 30%, most preferably about 22% (the zinc-aluminum eutectoid composition) by weight aluminum, together with from about 60% to about 83%, preferably from about 70% to about 80% zinc, most preferably about 78% zinc. The product produced and the process for producing that product have the following advantages:

(1) improved corrosion resistance compared to conventional galvanized steel;

(2) the flux used in the process does not produce corrosive fumes (e.g., hydrochloric acid) when the fluxed article is dipped in the galvanizing bath;

(3) the temperature for the galvanizing bath can be lower than for Galvalume and other high temperature galvanizing procedures (560–600° C.), which saves fuel costs;

(4) the eutectoid coating is more ductile than a typical zinc-iron alloy coating;

(5) the flux used in the process can be combined with the acid pickling bath, and (6) leaching of zinc into the environment from galvanized parts exposed outdoors is greatly reduced.

The steel product of the present invention has a coating which comprises at least two layers. The inner layer, which is in contact directly with the steel surface, is made up predominantly (i.e., at least about 50%) of intermetallic iron-aluminum compounds (with the possibility of some zinc present) generally having the formula Fe (Zn) Al. An example of such a compound has the formula $Fe_{2-x}(Zn)_xAl_5$, wherein x=0to 0.5. As used herein, the term "intermetallic iron-aluminum compounds" is intended to include those compounds having some zinc present in them. Alloys which may be present in the inner layer are intermediate iron aluminates, such as $Fe_2Al_5$, $FeAl_2$ and $Fe_2Al_3$, with $Fe_2Al_5$ being particularly preferred. The outer layer comprises predominantly intermetallic zinc-aluminum compound (with the possibility of some iron present) containing from about 17% to about 40%, preferably from about 20% to about 30%, most preferably about 22% (i.e., the zinc-aluminum eutectoid), by weight aluminum. The composition of the outer layer will correspond to the composition of the galvanizing bath. As used herein, the term "intermetallic zinc-aluminum compounds" is intended to include those alloys having some iron present in them. The thickness of the inner layer is from about 50 $\mu$m to abut 100 $\mu$m, preferably about 75 $\mu$m; and the thickness of the outer layer is from about 10 $\mu$m to about 50 $\mu$m, preferably about 25 $\mu$m.

It is to be emphasized that it is the batch galvanization process of the present invention (longer reaction time (e.g., about 3 minutes), lower temperature (e.g., 510–530° C.)) which provides the desired multi-layer structure to the finished coating. A continuous galvanization process using a bath which contains zinc and aluminum (about 10 seconds, 590–600° C.), provides a relatively thin (5–20 $\mu$m) single layer coating containing a zinc-aluminum alloy.

Another benefit of the present invention is that it permits the pickling and the fluxing steps to be combined into a single step thereby resulting in a galvanizing process which is much simpler than the current processes. This combination of steps is possible since acid, such as hydrochloric acid, is used in the pickling step and is also used to provide the acid pH in the fluxing step where a metal, such as tin, is electrolessly plated on the steel article. Acids useful in this combined fluxing/pickling step include sulfuric acid, phosphoric acid, hydrochloric acid, and mixtures thereof, with hydrochloric acid being preferred since it is useful at lower temperatures. Preferred salts which may be used to deposit the metal on the steel article in the fluxing/pickling step include copper chloride, tin chloride, and mixtures thereof, although any of the salts discussed above may be used. A preferred aqueous solution for the combined fluxing/pickling step comprises from about 1% to about 15%, preferably about 10% HCl, and from about 1% to about 25%, preferably about 10%, $SnCl_2$. The precise amount of acid used is adjusted based on the amount of rust present on the steel articles. For example, if the steel articles are only lightly rusted, then a 5% HCl solution may be appropriate, while a 10% HCl solution may be required if the articles are more heavily rusted. The combined fluxing/pickling steps may be carried out for a time period of from about 1 to about 10 minutes, preferably from about 2 to about 5 minutes; at a temperature of from about 50 to about 100° C., preferably from about 70 to about 80° C.; from an aqueous solution having a pH from about 1 to about 7, preferably from about 1 to about 4. The immersion time in the combined fluxing/pickling step will also depend on the amount of surface rust on the article being treated.

Although the process of the present invention was developed for use in batch galvanization, it may also be advantageously used as part of a continuous galvanization process. While fluxing is frequently not necessary in a continuous process to protect the metal surface from oxidation, since a protective atmosphere is used to shield the metal surface, sometimes, in the absence of such atmosphere, flux is used to protect the metal surface from oxidation. In addition, flux can be used to activate the metal surface prior to immersion in the zinc bath. In that context, the process of the present invention provides the following advantages over conventional (e.g., zinc ammonium chloride) fluxes:

(1) the toxic fumes which are formed when the fluxed steel is dipped in the molten zinc are eliminated;

(2) a more uniform coating is formed in the galvanization process; and (3) the steel strip may be heated to a higher temperature prior to being galvanized, thereby minimizing temperature loss of the zinc bath.

The fluxing process, when used in a continuous galvanization operation, is similar to the batch process, described above, except it is accomplished on steel strip in a more rapid time frame. For example, the pickling step generally takes place for from about 3 to about 15 seconds in acid (generally hydrochloric or sulfuric acid) at a temperature of from about 40° C. to about 60° C. The fluxing step is generally carried out for from about 3 to about 14 seconds at a temperature ranging from room temperature to about 75° C. The flux, itself, may be any of the metals discussed above. However, preferred flux compositions comprise $SnCl_2$ (at the levels described above) together with from about 0% to about 2% (preferably about 1%) by weight of the flux bath $CuCl_2$. Thus, the preferred flux is a tin/copper alloy. Finally, in a continuous process the immersion time for the steel strip in the zinc bath is only a few seconds.

The following examples are intended to be illustrative of the processes of the present invention and are not intended to be limiting thereof.

EXAMPLE 1

The high aluminum steel of the present invention, as produced in a batch galvanization operation, is illustrated by the following example.

Steel panels (AISI 1018 hot rolled) are degreased in 10 wt % NaOH solution heated between 65° C.–80° C. for about 5 minutes. The steel panels are then rinsed and pickled in 12% HCl aqueous solution at room temperature for about 5 minutes. The aqueous flux bath is composed of 10 wt % $SnCl_2.2H_2O$ and 5 wt % HCl and is maintained at a temperature of 75° C. Pickled panels are immersed in the fluxing bath for 1 minute. The panels are then rinsed and dried. The fluxed panels are hot dipped in a molten eutectoid zinc-aluminum (22.3%) bath maintained at 520° C. for 3 minutes. The panels are galvanized well, with complete coverage and thickness of 120 $\mu$. The coating comprises a two-layer alloy structure; the inner layer is a combination of Fe—Al intermetallic alloy phases with some iron substituted by zinc and the outer layer comprises a drag-out layer having the bath eutectoid composition with some Fe in it. The inner layer includes a major portion of intermetallic iron-aluminum compounds, such as $Fe_2Al_5$.

EXAMPLE 2

The high aluminum steel of the present invention and the process for making it is illustrated in the following example, and is compared to a prior art process.

Hot rolled AISI 1018 steel panels are degreased in 10 wt % NaOH solution heated between 65° C.–80° C. for about 5 minutes. The steel panels are then rinsed and pickled in 12% HCl aqueous solution at room temperature for about 5 minutes. One set of pickled panels is simply set aside, a second set of panels is treated with a conventional zinc ammonium chloride flux and the third set with the flux disclosed in the present application. The second set of panels is fluxed in solution comprising 90% $ZnCl_2$, 9% NaCl and 1% phenoxy trimethyl ammonium chloride at a concentration of 500 g/l and at a temperature of 70° C. for a minute, as described in U.S. Pat. No. 5,292,377, Izeki, et al., (Tanaka Galvanizing/Sumitomo Metal Mining), issued Mar. 8, 1994. The panels are then dried in hot blown air. The third set of panels is treated in an aqueous flux bath comprising 10 wt % $SnCl_2$, $2H_2O$.0.75% $CuCl_2$ and 5 wt % HCl at room temperature as described in the present application. The panels are immersed in the fluxing bath for a few seconds. The panels are then rinsed and dried in hot blown air. The panels are hot dipped in a molten eutectoid zinc-22.3% aluminum bath maintained at 525° C. for 3 minutes. The first two sets of panels have very poor galvanized coatings with several bare patches. The third set of panels is galvanized well with complete coverage and no bare patches and had a coating thickness of 125 $\mu$m

EXAMPLE 3

The product and process of the present invention are illustrated by the following example, the product is shown to have good corrosion resistance.

Hot rolled AISI 1018 steel panels are degreased in 10 wt % NaOH solution heated between 65° C.–80° C. for about 5 minutes. The steel panels are then rinsed in warm water for a minute. The panels are then pickled in 12 wt % HCl at room temperature for 5 minutes. The panels are immersed in the flux bath immediately. The aqueous flux bath is composed of 10 wt % $SnCl_2.2H_2O$ and 10 wt % HCl and is maintained at a temperature of 75° C. The panels are immersed in the fluxing bath for 2 minutes. The panels are then rinsed and dried. Some fluxed panels are hot dipped in a molten zinc bath maintained at 455° C. for 3 minutes. These panels have excellent galvanized surfaces with complete coverage, exhibiting bright spangles. The remaining fluxed panels are hot dipped in a eutectoid Zn—Al bath maintained at 525° C. for 3 minutes. The panels have a good Zn—Al alloy coating with complete coverage and no surface defects. All the panels are then subjected to salt spray testing for 48 hours. The Zn—Al alloy coated panels of the present invention performed better, having almost no white rust; they had also developed a layer of passivating corrosion products.

EXAMPLE 4

The products and process of the present invention are illustrated by the following example.

Cold rolled AISI 1010 steel panels are degreased in 10 wt % NaOH solution heated between 65° C.–80° C. for about 5 minutes. The steel panels are then rinsed in warm water for about one minute. They are pickled in a 12% HCl aqueous solution for 3 minutes. One set of panels is treated in 10 wt% $SnCl_2.2H_2O$ and 5%HCl maintained at 75° C. for 3 minutes. Another set of panels is fluxed in an aqueous flux bath composed on 10 wt % $SnCl_2.2H_2O$, 1 wt % $CuCl_2$ and 5 wt % HCl and maintained at room temperature for a few seconds. All the panels are rinsed and dried using warm blown air. The panels are set aside for 24 hours and then hot dipped in a molten eutectoid zinc-aluminum (22.3%) bath maintained at 525° C. for 3 minutes. All the panels are galvanized well, with complete coverage and a regular coating as described in the present application.

What is claimed is:

1. A process for hot-dip batch galvanization of a steel article comprising the steps of:

(a) fluxing said steel article by electroless plating on the surface of said steel article a layer of a metal, wherein said metal is selected from the group consisting of tin, copper, nickel, and mixtures thereof; and (b) galvanizing said steel article by dipping it in a bath consisting essentially of molten zinc and from about 17%, by weight, to about 40%, by weight, molten aluminum, such that the metal layer on the steel article is directly contacted by the galvanizing bath.

2. The process according to claim 1 wherein the metal layer has a thickness of from about 1 nm to about 10 $\mu$m.

3. The process according to claim 2 wherein the fluxing step is carried out for from about 1 to about 10 minutes, at a temperature of from about 50° C. to about 100° C., at a pH of from about 1 to 7.

4. The process according to claim 3 wherein the metal is tin.

5. The process according to claim 4 wherein the metal layer is deposited from an aqueous solution comprising hydrochloric acid and stannous chloride.

6. The process according to claim 5 wherein the fluxing step is carried out for from about 2 to about 5 minutes, at a temperature of from about 70° C. to about 80° C., at a pH of from about 1 to about 4.

7. The process according to claim 3 wherein the galvanizing step is carried out for from about 1 to about 5 minutes at a temperature of from about 500° C. to about 600° C.

8. The process according to claim 7 wherein the galvanizing step is carried out for from about 2 minutes to about 3 minutes at a temperature of from about 510° C. to about 530° C.

9. The process according to claim 3 wherein, prior to fluxing, the article is degreased by dipping it in an alkaline solution and is pickled by dipping it in an acid solution.

10. The process according to claim 3 wherein the galvanizing bath comprises from about 20% to about 30% by weight aluminum.

11. The process according to claim 10 wherein the galvanizing bath comprises about 22%, by weight, aluminum.

* * * * *

UNITED STATES PATENT AND TRADEMARK OFFICE

CERTIFICATE OF CORRECTION

PATENT NO. : 6,372,296 B2
DATED : April 16, 2002
INVENTOR(S) : van Ooij et al.

It is certified that error appears in the above-identified patent and that said Letters Patent is hereby corrected as shown below:

Title page,
Item [56], References Cited,
U.S. PATENT DOCUMENTS, the following should be inserted:

| | | | | |
|---|---|---|---|---|
| -- 4,056,366 | A | 11/1977 | Lee et al. | 29/653 |
| 4,448,748 | A | 5/1984 | Radtke et al. | 420/514 |
| 4,954,184 | A | 9/1990 | Conn | 148/24 |
| 5,292,377 | A | 3/1994 | Izeki et al. | 148/23 -- |

FOREIGN PATENT DOCUMENTS, the following should be inserted:

| | | |
|---|---|---|
| -- JP | 4-157146 | 5/1992 |
| JP | 5-117835 | 5/1993 |
| JP | 5-148602 | 6/1993 |
| JP | 5-195179 | 8/1993 |
| JP | 7-233459 | 9/1995 |
| GB | 1 502 673 | 3/1978 -- |

Signed and Sealed this

Eighth Day of October, 2002

*Attest:*

*Attesting Officer*

JAMES E. ROGAN
*Director of the United States Patent and Trademark Office*